US008808045B2

(12) United States Patent
Lundqvist et al.

(10) Patent No.: US 8,808,045 B2
(45) Date of Patent: Aug. 19, 2014

(54) METHOD AND SYSTEM FOR CONTROLLING THE EXHAUST GASES FROM AN ENGINE

(75) Inventors: Thorbjörn Lundqvist, Västra Frölunda (SE); Jens Blomqvist, Göteborg (SE); Aniko Holm, Hönö (SE)

(73) Assignee: AB Volvo Penta, Göteborg (SE)

( * ) Notice: Subject to any disclaimer, the term of this patent is extended or adjusted under 35 U.S.C. 154(b) by 266 days.

(21) Appl. No.: 13/256,968

(22) PCT Filed: Mar. 20, 2009

(86) PCT No.: PCT/SE2009/000147
§ 371 (c)(1),
(2), (4) Date: Oct. 25, 2011

(87) PCT Pub. No.: WO2010/107345
PCT Pub. Date: Sep. 23, 2010

(65) Prior Publication Data

US 2012/0252288 A1 Oct. 4, 2012

(51) Int. Cl.

| | |
|---|---|
| ***B63H 20/24*** | (2006.01) |
| ***B63H 20/26*** | (2006.01) |
| ***B63H 21/32*** | (2006.01) |
| ***F01N 13/12*** | (2010.01) |
| *B63H 5/125* | (2006.01) |
| *B63H 5/07* | (2006.01) |

(52) U.S. Cl.
CPC ..... *F01N 13/12* (2013.01); *B63H 20/24* (2013.01); *B63H 2005/1254* (2013.01); *B63H 2005/075* (2013.01); *B63H 21/32* (2013.01)
USPC ..... 440/89 G; 440/89 R; 440/89 A

(58) Field of Classification Search
CPC ..... B63H 20/24; B63H 20/245; B63H 20/26; B63H 21/32; B63H 21/34; B63H 2005/1254; F01N 13/12; F01N 13/087
USPC ..... 440/89 R–89 J
See application file for complete search history.

(56) References Cited

U.S. PATENT DOCUMENTS 4,957,461 A * 9/1990 Nakayama ..... 440/89 R
5,134,851 A 8/1992 Davis (Continued)

OTHER PUBLICATIONS

International Search Report for corresponding International Application PCT/SE2009/000147.

(Continued)

*Primary Examiner* — Ajay Vasudeva
(74) *Attorney, Agent, or Firm* — WRB-IP LLP

(57) ABSTRACT

A method for controlling the exit of exhaust gases from an engine which is used to power an underwater propeller drive arranged at the hull bottom of a boat is provided. According to the method exhaust gases are allowed to flow from the engine through an exhaust channel and exit through a first underwater exhaust outlet in the underwater propeller drive. According to the method, if the engine is running and the transmission of the propeller drive is in neutral position, a second underwater exhaust outlet is opened for letting exhaust gases in the exhaust channel exit in a position closer to the hull bottom of the boat than the first underwater exhaust outlet.

12 Claims, 8 Drawing Sheets

(56) References Cited

U.S. PATENT DOCUMENTS 5,298,794 A * 3/1994 Kuragaki ..... 307/95
5,421,756 A * 6/1995 Hayasaka ..... 440/89 R
5,967,866 A 10/1999 Willows et al.
7,186,157 B2 * 3/2007 Mansson et al. ..... 440/89 R
7,387,556 B1 * 6/2008 Davis ..... 440/89 A

OTHER PUBLICATIONS

JP 07144695 A, Shanshi Ind. Co Ltd., Jun. 6, 1995 (abstract) Retrieved from PAJ database.

* cited by examiner

METHOD AND SYSTEM FOR CONTROLLING THE EXHAUST GASES FROM AN ENGINE

BACKGROUND AND SUMMARY

The present invention discloses a method and a system for an improved propeller drive of the underwater kind.

Certain kinds of propeller drives for boats are arranged on the hull bottom of the boat, as opposed to, for example, propeller drives which are arranged at the aft of the boat. In such propeller drives, the exhaust gases from the engine to which the drive is connected are usually let out via an exhaust channel, through an exhaust outlet opening which is below the water line, and which is also below the hull of the boat.

With a propeller drive which is arranged on the hull bottom of the boat, when the boat is moving, the exhaust gases will rise upwards to the surface of the water, and dissipate behind the boat or to the sides of the boat. However, if the boat is standing still with the engine running, i.e. if the transmission of the propeller drive is in the idle position, the exhaust gases will still rise upwards, but at least part of the exhaust gases may hit the hull bottom of the boat. Although usually imperceptible by those aboard the boat, there is still a desire to reduce or entirely eliminate any noise, vibrations and other undesired effects caused by this effect.

Thus, as stated above, there is a need for a solution by means of which an underwater propeller drive arranged on the hull bottom of a boat can be made even quieter and offer an increased degree of comfort when the engine is running and the transmission of the propeller drive is in the idle position.

According to an aspect of the present invention, a method is provided for controlling the exit of exhaust gases from an engine which is used to power an underwater propeller drive which is arranged at the hull bottom of a boat. The method of an aspect of the invention comprises letting the exhaust gases flow from the engine through an exhaust channel and exit through a first underwater exhaust outlet in the underwater propeller drive.

According to the method of an aspect of the invention, if the engine is running and the transmission of the propeller drive is in neutral position, a second underwater exhaust outlet is opened for letting exhaust gases in the exhaust channel exit in a position closer to the hull bottom of the boat than the first underwater exhaust outlet.

As will be discussed in more detail below, tests have shown the inventors of the present invention that this solution, i.e. the use of a second underwater exhaust, considerably reduces or even eliminates any noise, vibrations and other undesirable effects caused by the exhaust gases when the engine is running and the transmission is in the idle position, if the second exhaust outlet is closer to the hull bottom of the boat than the first exhaust outlet is.

The second underwater exhaust outlet can be designed or obtained in a number of ways within the scope of the present invention. In one embodiment of the invention, the second underwater exhaust outlet is a vent in an underwater housing of the propeller drive, and is arranged closer to the hull bottom of the boat than the first underwater exhaust outlet is.

In another embodiment of the method of the invention, a first part of the underwater propeller drive is rotatable about a second part which is attached to the hull bottom of the boat, and the exhaust channel comprises a first opening in the first part which faces a second opening in the second part. The first and second openings have corresponding forms and shapes, so that they cooperate to form part of the exhaust channel. According to this embodiment of the method of the invention, the second underwater exhaust outlet is opened by means of rotating the first part to a predefined angle relative to the second part. Thus, in this embodiment, the second underwater exhaust outlet is suitably opened by means of non-coinciding portions of the first and second openings.

The present invention also discloses a system which operates according to the basic principles described above.

Both the method and the system of the invention will be described in more detail in the text which follows below,

BRIEF DESCRIPTION OF THE DRAWINGS

The invention will be described in more detail in the following, with reference to the appended drawings, in which.

DETAILED DESCRIPTION

Figure 1A:
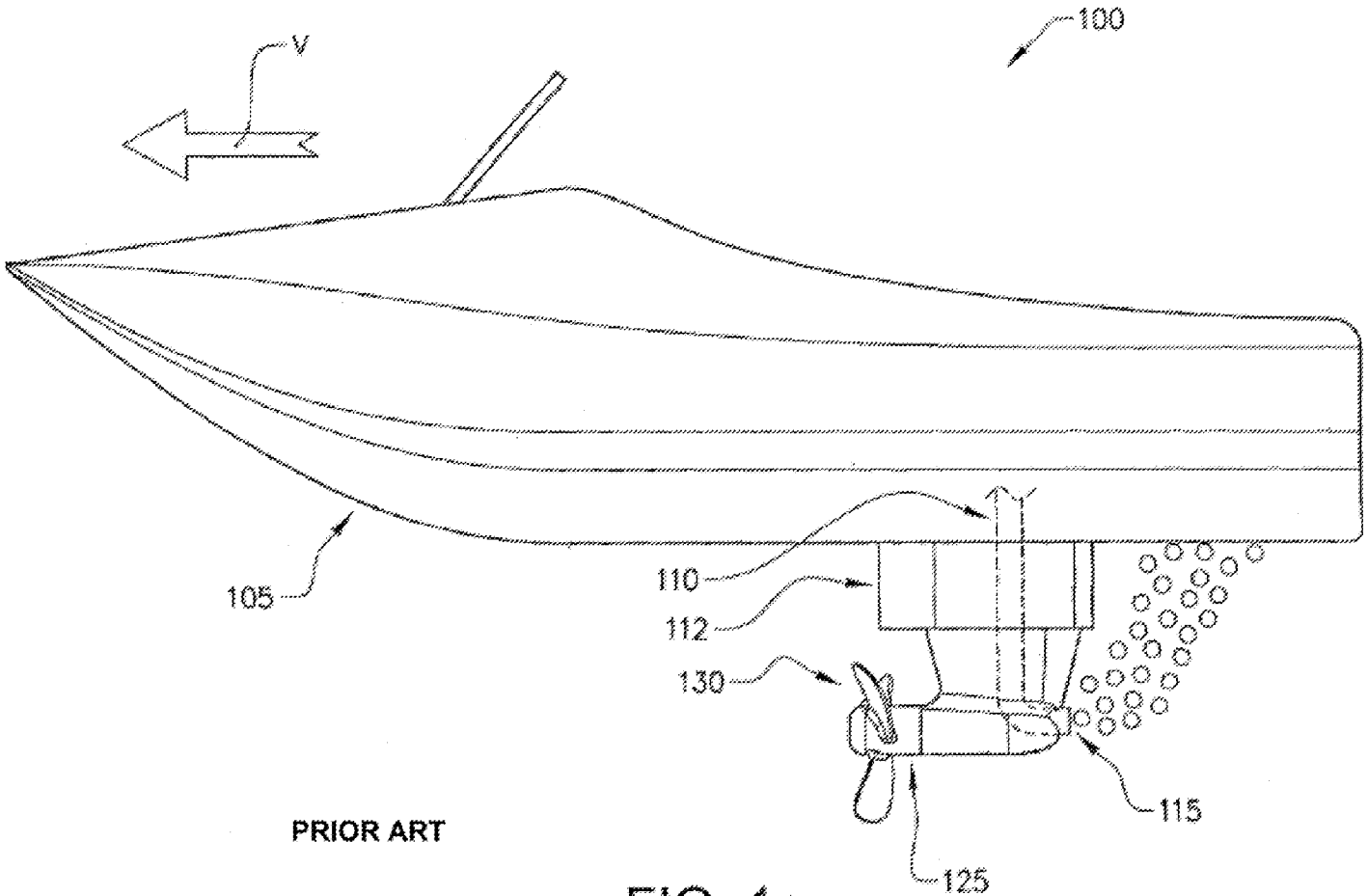
FIG. 1a PRIOR ART
FIGS. 1*a* and 1*b* show examples of conventional underwater propeller drives in which the present invention is applicable.

FIG. 1*a* shows a system 100 in which the present invention can be applied. As has been mentioned above, the system 100 comprises an underwater propeller drive for a boat (the boat not being shown in its entirety), where the underwater propeller drive is attached at or to the hull bottom of the boat.

The hull bottom of the boat is indicated as 105 in FIG. 1*a*, and as shown, the system comprises an exhaust channel 110 for exhaust gases from an engine (not shown) to which the propeller drive is attached. The exhaust gases from the engine flow through the channel 110 and exit through a first underwater outlet 115, which usually is an opening that terminates the channel 110.

As shown in FIG. 1*a*, the underwater propeller drive will also usually comprise a housing 112, and also comprises a propeller shaft 125 and a propeller 130.

Figure 1B:
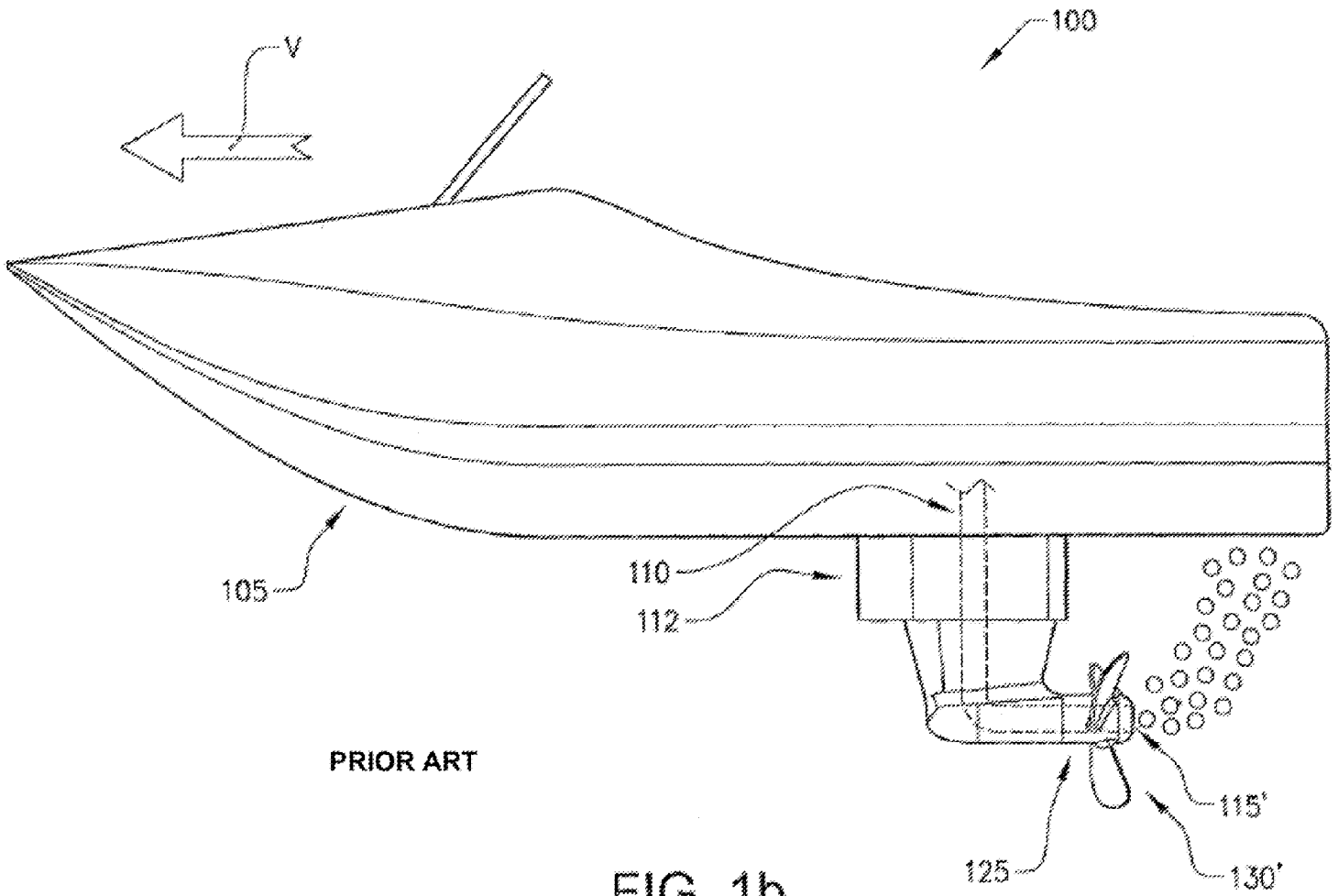
FIG. 1b PRIOR ART

It should be noted that the underwater propeller drive shown in FIG. 1*a* and also in the following, with the exception of FIG. 1*b*, is a propeller drive of the "pulling" or "tractor" propeller kind, as opposed to a propeller drive which is a "pushing" propeller. The fact that the drive shown in FIG. 1*a* uses a pulling propeller is indicated by means of an arrow "V", which indicates the forward direction of travel of the boat.

However, the present invention may also be applied in propeller drives with "pushing" propellers. Such a drive is shown in FIG. 1*b*, in which the parts and components have retained their reference numbers from FIG. 1*a*, with the exception of the propeller 130' and the exhaust outlet 115'. As shown in FIG. 1*b*, the propeller 130' is a "pushing" propeller, and has its exhaust outlet 115' arranged as an opening in the centre of the propeller hub.

The invention is applicable in both kinds of propeller drives. i.e. both pulling propellers, shown in FIG. 1*a*, and pushing propellers, shown in FIG. 1*b*. While pulling and pushing propellers are conventional, it will be appreciated that the present invention comprises combinations including such otherwise conventional structures.

In addition, the propeller drive in which the invention is applied can comprise one or more propellers, although only one propeller will be shown in the examples described here and shown in the drawings.

If the boat is moving, the exhaust gases which exit through the first exhaust outlet 115 will rise to the surface of the water behind or to the sides of the boat, where the gases will dissipate into the atmosphere. However, if the boat is not moving and the engine is still running, i.e. the transmission of the propeller drive is in the neutral position, at least part of the exhaust gases which rise from the outlet 115 will hit the hull bottom 105 of the boat, as indicated in FIG. 1, which may in some cases cause a very slight and usually imperceptible increase in the noise level and level of vibrations. It is a purpose of the present invention to reduce or entirely eliminate any possible such effects.

Figure 2:
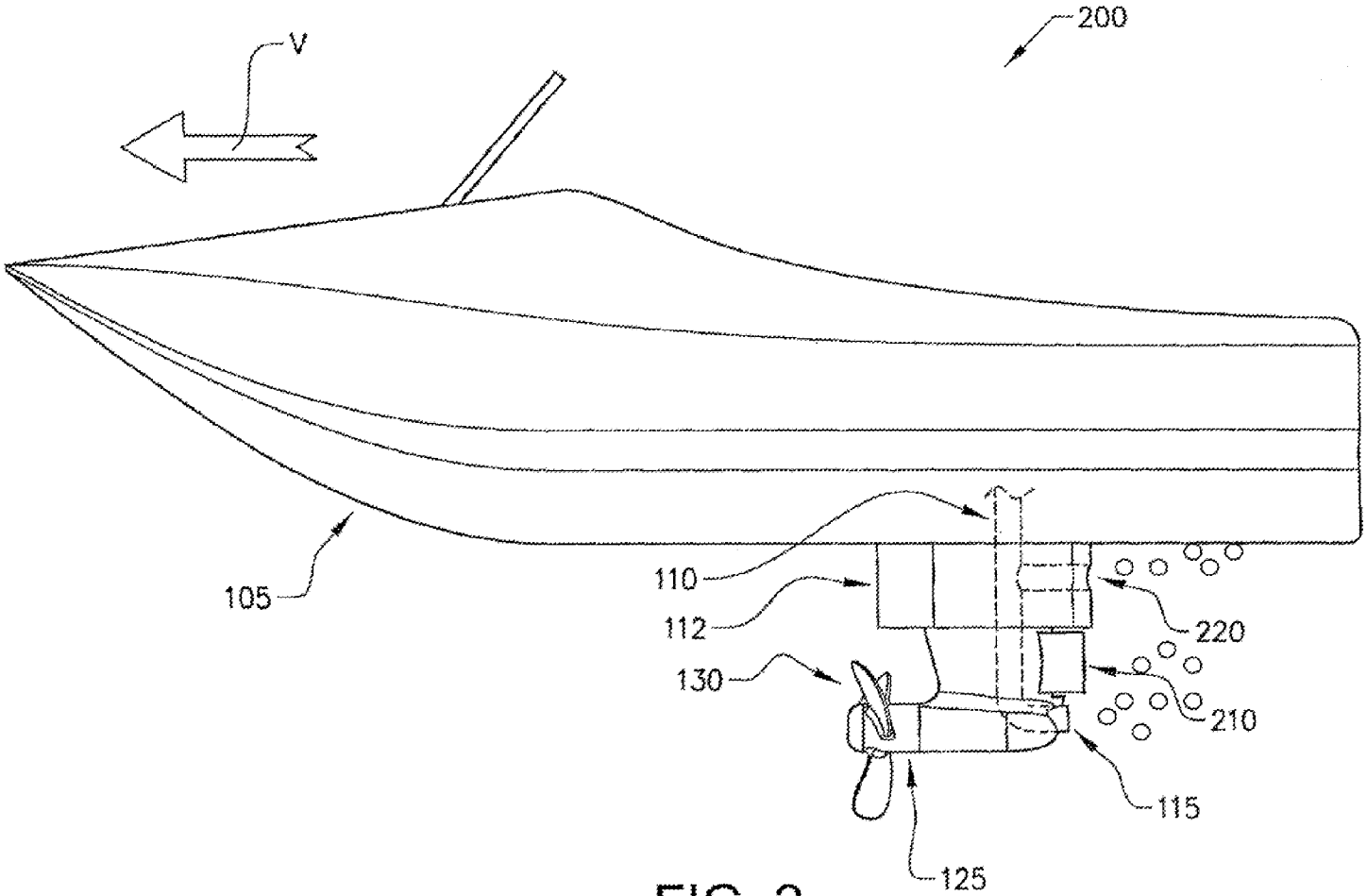
FIG. 2 shows a first embodiment of an underwater propeller drive with the invention.

FIG. 2 shows a first embodiment 200 of the present invention: components which have already been shown in FIG. 1 and described in connection to FIG. 1 have retained their reference numbers from FIG. 1, and will not be described again here.

In the embodiment 200 shown in FIG. 2, the housing 112 of the underwater•propeller drive comprises a rudder 210, by means of which steering of the boat is achieved. As is also shown, the drive 200 comprises a second underwater exhaust outlet 220, which in this embodiment is a valve or vent in the exhaust channel 110, which can be opened so that exhaust gases from the exhaust channel 110 can exit through it. As shown in FIG. 2, the second underwater exhaust outlet 220 is arranged closer to the hull bottom 105 of the boat than the first underwater exhaust outlet 115 is.

The inventors of the present invention have discovered that by opening the second outlet 220, any discomfort caused by exhaust gases when the engine is running and the transmission of the propeller drive is in neutral position can be reduced or entirely eliminated. For this reason, a control unit (not shown here) for the system 200 is connected to the engine and to the propeller drive, in order to sense if the engine is running and the transmission of the propeller drive is in the neutral position, i.e. the two conditions under which at least part of the exhaust gases from the first outlet 115 may hit the hull bottom 105 of the boat. If both of these two conditions are met, the control unit is, according to the invention, arranged to open the second exhaust outlet 220, so that exhaust gases from the exhaust channel 110 can exit through it.

It should be pointed out that in the embodiment described here, the first underwater exhaust outlet is not closed, so exhaust gases will be able to exit from the channel 110 through both the first 115 and the second 220 underwater exhaust outlets. However, it is entirely within the scope of the present invention to close the first underwater exhaust outlet 115 when the condition for opening the second outlet 220 is met. In such an embodiment, the exhaust channel 110 and/or the first underwater exhaust outlet 115 would have to be provided with a means for closing the first outlet 115, i.e. a lid or cover etc. which could be closed by the control unit when the second outlet 220 is opened.

Figure 3:
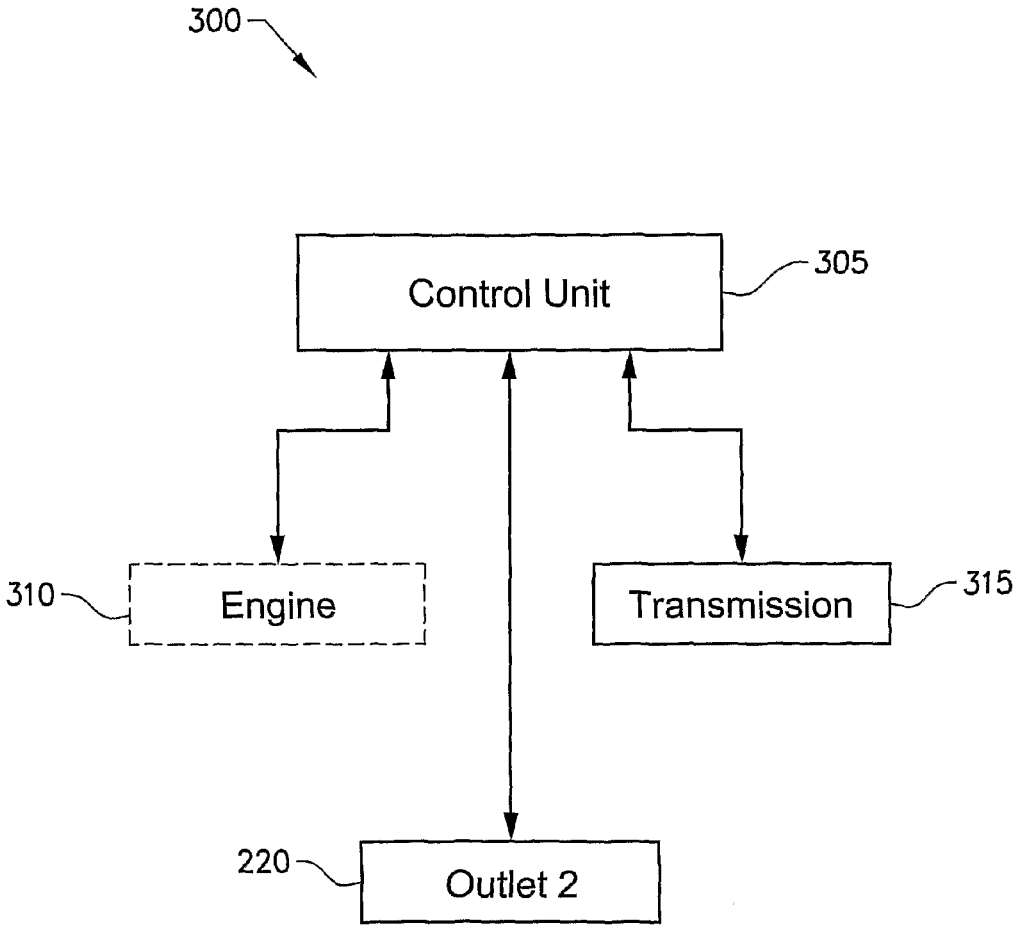
FIG. 3 shows a block diagram of a system of the invention.

FIG. 3 shows a schematic block diagram of a system 300 of the invention: as indicated previously, the system 300 comprises a control unit 305, which is arranged to sense if the engine 310 (shown with dashed lines, since the engine per se is not comprised in the system 300) is running. The control unit 305 is also arranged to sense if the transmission 315 of the propeller drive is in the neutral position. In addition, the control unit 305 is arranged to open and close the second exhaust outlet 220, depending on whether or not the engine 315 is running and the transmission 320 is in the neutral position, and to close the second exhaust outlet 325 otherwise.

Figure 4:
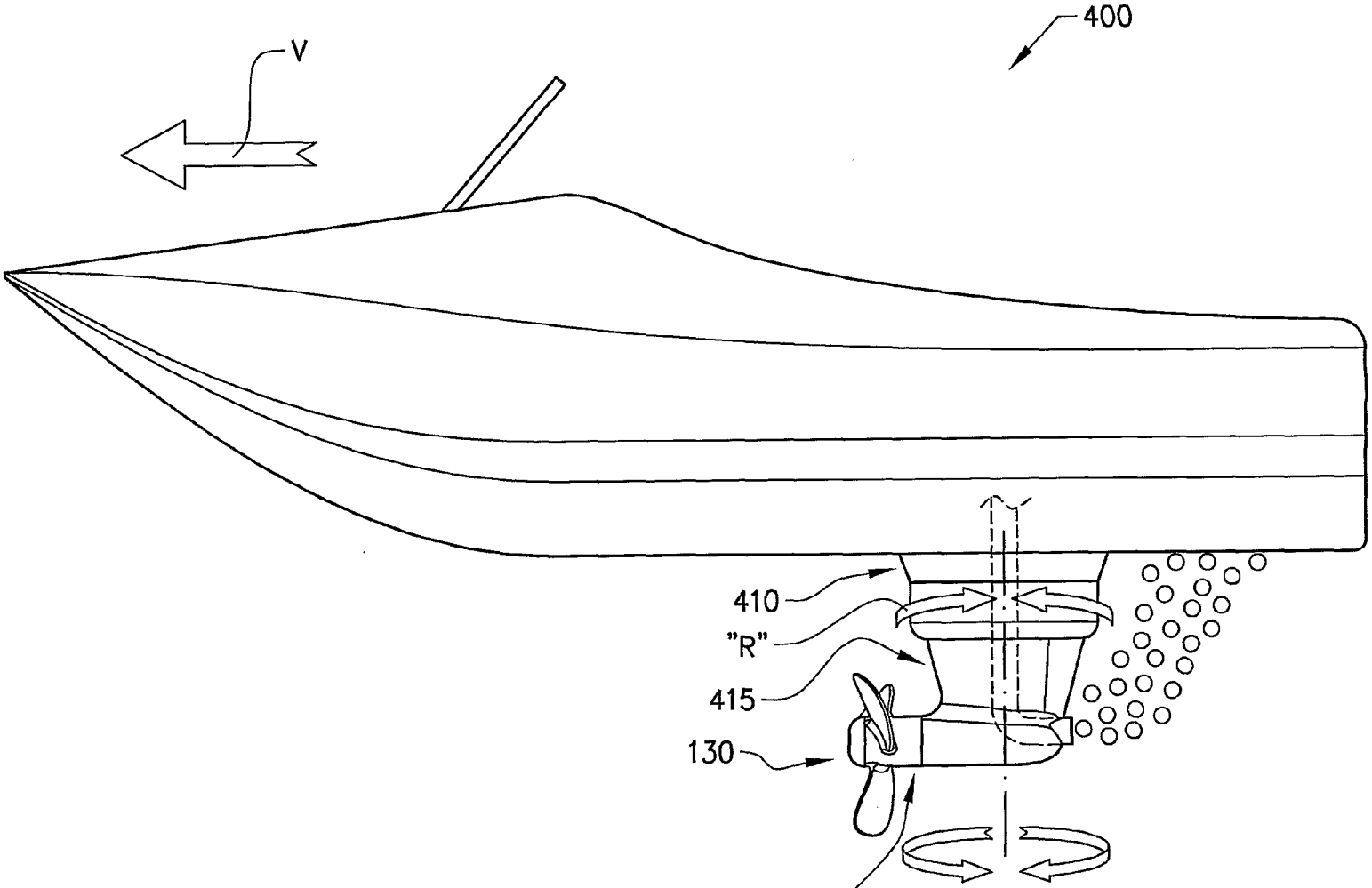
FIG. 4 shows a second embodiment of an underwater propeller drive with the invention.

FIG. 4 shows another embodiment 400 of an underwater propeller drive in which the present invention can be used. Components in the embodiment 400 which have been described previously will not be described again here, and have retained their reference numbers from previous drawings.

A difference between the underwater propeller drive 400 as compared to the underwater propeller drive 200 of FIG. 2 is that the drive 400 uses a different method for the steering of the boat: as shown in FIG. 4, the drive 400 comprises a housing 415 from which the propeller shaft 125 protrudes, and which also houses the first underwater exhaust outlet—115. The housing 415 is rotatably attached to a component 410 which is attached to the hull bottom 105 of the boat. The direction of rotation of the housing 415 is indicated by means of the letter "R" in FIG. 4, as well as by means of arrows in FIG. 4.

By means of rotating the housing 415 relative to the part 410, the boat can be steered, since the direction of the propeller shaft 125 will change with the rotation of the housing 415.

The rotation of the housing 415 is suitably carried out by means of a (not shown) control unit, which is adapted to sense variations in a steering means such as a steering wheel or a tiller etc which is provided for the driver of the boat.

It should be pointed out that the rotation of the rotatable part 415 is relative to the part 410; thus, although not explicitly described here, the part 410 may be rotatably attached to the hull bottom 105 of the boat, as an alternative to having the part 410 fixedly attached to the hull bottom 105. In addition, it will be realized that the solution 400 shown in FIG. 4, i.e. a drive which steers the boat by means of at least one rotatable part 415 may require sealing means where the parts 415 and 410 meet. In order to facilitate for the reader, such sealing means are not shown in FIG. 4, nor described here.

Figure 6:
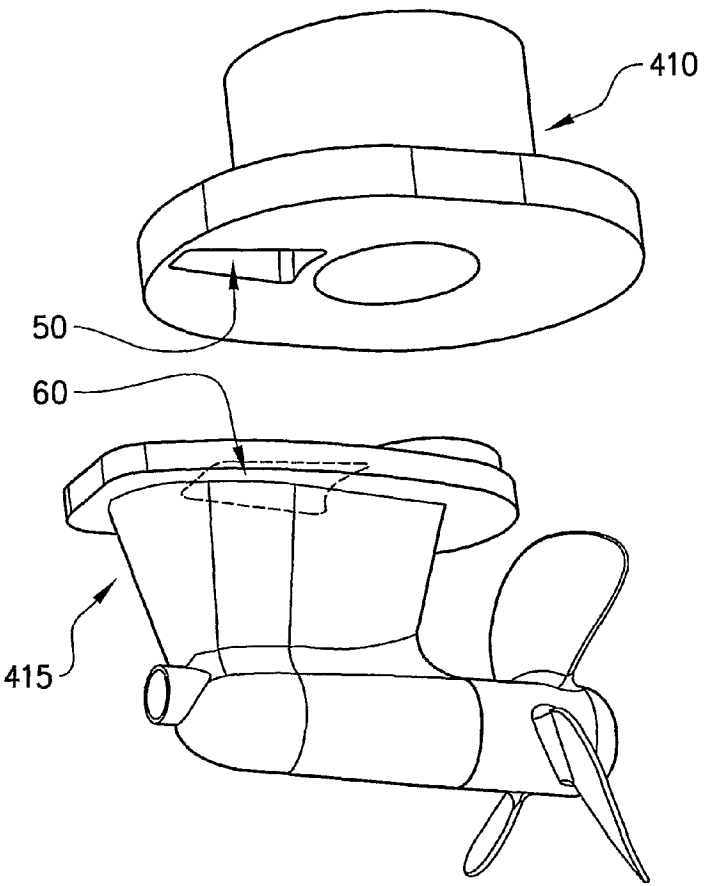
FIGS. 5-7*f* show different versions of one embodiment of the invention.
Figure 5:
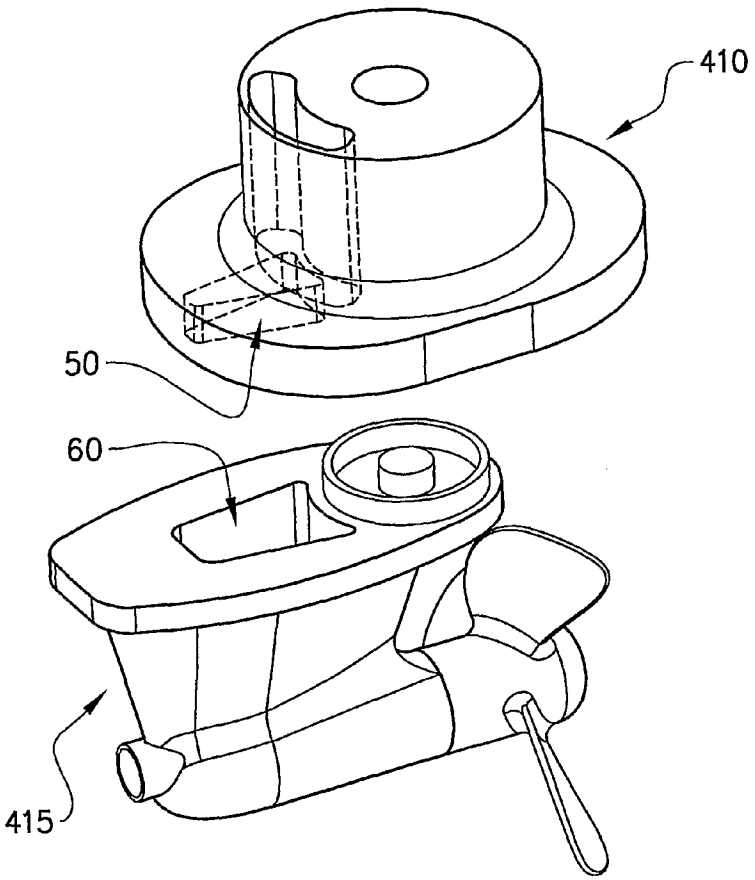
Figure 7C:
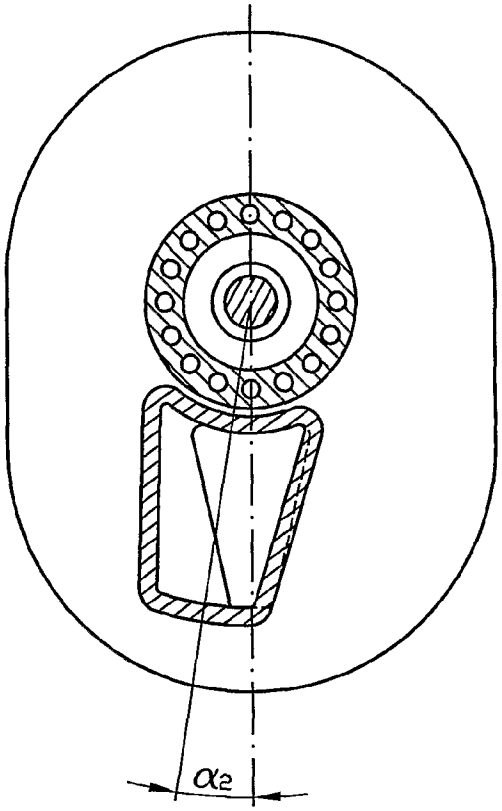
Figure 7B:
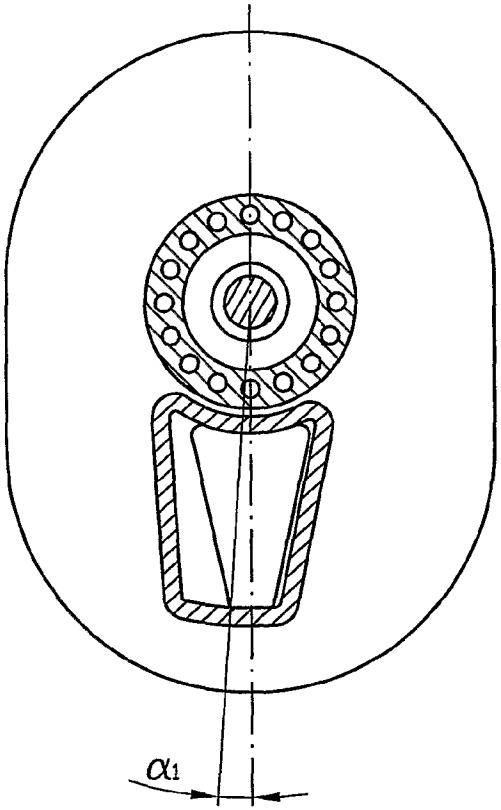
Figure 7A:
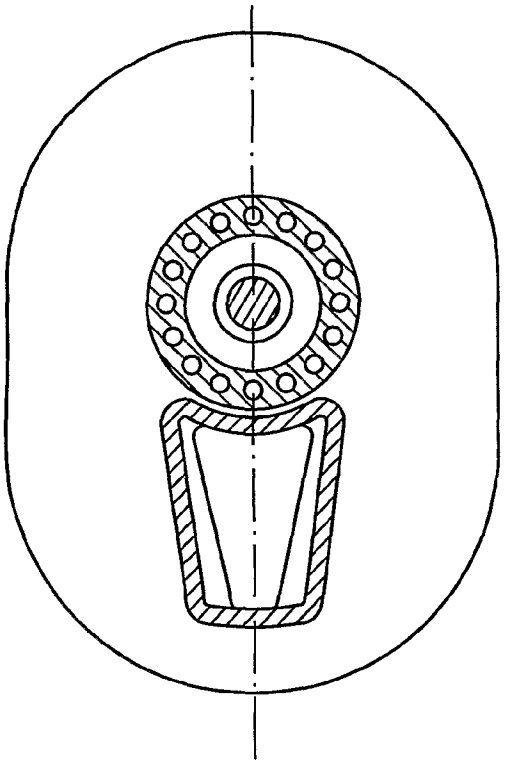
Figure 7F:
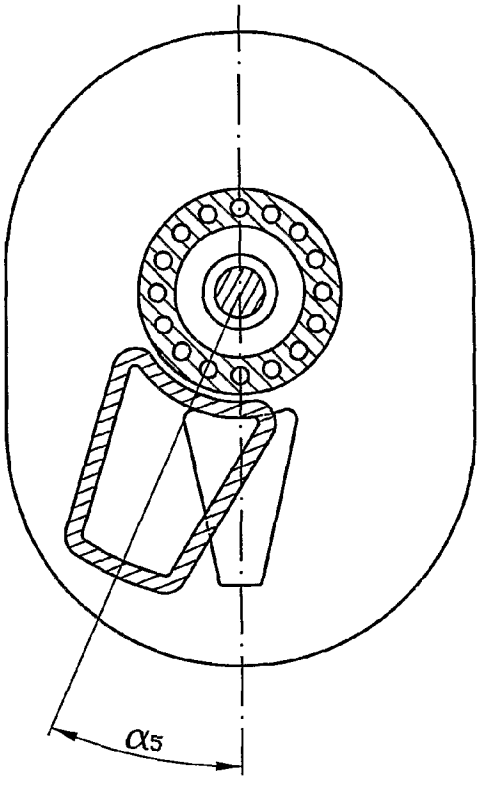
Figure 7E:
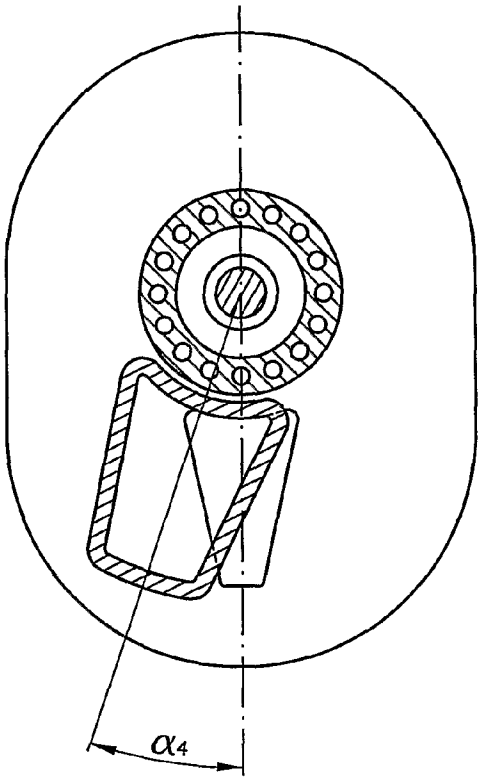
Figure 7D:
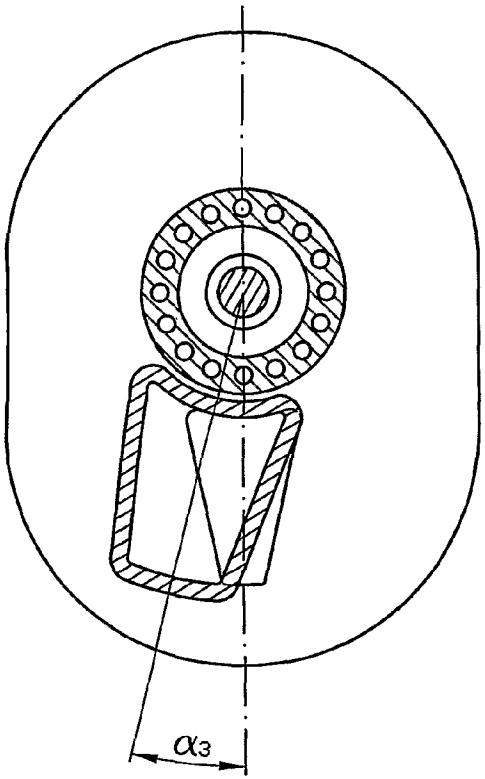

As shown in FIG. 4, the underwater propeller drive 400 is also provided with an exhaust channel 110. However, in the embodiment 400, the housing 415, i.e. the rotatable part of the drive 400, comprises an opening which faces a corresponding opening in the part 410 about or relative to which the housing is rotatable. This is shown in FIGS. 5 and 6, which schematically shows the rotatable part 415 and the part 410 about which the rotatable part 415 rotates. In FIGS. 5 and the 6, the opening 50 in the part 410 and the opening 60 in the part 415 are shown.

The two openings 50, 60, as shown in FIGS. 5 and 6, face each other in the propeller drive and suitably have a size and shape which essentially coincide with each other, so that when the rotatable part 415 is in a position which corresponds to "straight" movement of the boat, the two openings will be aligned with each other to form a contiguous part of the exhaust channel 110. It will be realized that when the rotatable part 415 is rotated to steer the boat, the angle between the two openings 50, 60 will vary, as seen for example, relative to a "zero angle" which corresponds to straight movement for the boat. It will also be realized that when the angle between the two openings 50, 60 is greater or smaller than the "zero" angle, there will be portions of the two openings 50, 60 which do not coincide with each other, which will in effect create an additional outlet through which exhaust gases in the exhaust channel 110 may exit, the additional outlet being formed by the non-overlapping portions of the openings 50, 60.

The fact that an additional outlet may be created by means of rotating the rotatable part 415 in relation to the part 410 is utilized by the present invention in the following manner: the control unit 305 show in FIG. 3 is in this embodiment adapted to open a second exhaust outlet by means of rotating the part 415 to a predefined angle relative to the part 410, by means of which the second underwater exhaust outlet will be opened by means of non-coinciding portions of the first and second openings, through which exhaust gases form the exhaust channel 110.

FIGS. 7*a*-7*f* show the two openings, i.e. the opening 60 in the part 415 and the opening 50 in the part 410 in different angular positions α relative to each other. The angles shown in FIGS. 7*a*-7*f* are as follows:

| FIG. | Anqle α |
|---|---|
| 7a | 0° |
| 7b | 5° |
| 7c | 10° |
| 7d | 15° |
| 7e | 20° |
| 7f | 25° |

Although a range of angles α will create the effect of the second exhaust outlet, some angle ranges have been found to be particularly advantageous. One such range is in the interval of 1-30 degrees, with a second range being in the interval of 5-20 degrees, and a third range being in the interval of 8-12 degrees. In one embodiment, the angle used is 10 degrees.

The invention is not limited to the examples of embodiments described above and shown in the drawings, but may be freely varied within the scope of the appended claims.

The invention claimed is:

1. A method for controlling the exit of exhaust gases from an engine, the engine being used to power an underwater propeller drive which is arranged at the hull bottom of a boat, the method comprising letting the exhaust gases flow from the engine through an exhaust channel and exit through a first underwater exhaust outlet in the underwater propeller drive, when the engine is running and the transmission of the propeller drive is in neutral position, opening a second underwater exhaust outlet for letting exhaust gases in the exhaust channel exit in a position closer to the hull bottom of the boat than the first underwater exhaust outlet, wherein a first part of the underwater propeller drive is rotatable about a second part which is attached to the hull bottom of the boat, the exhaust channel comprises a first opening in the first rotatable part which faces a second opening in the second fixed part, the first and second openings having corresponding forms and shapes so as to cooperate to form part of the exhaust channel, and the second underwater exhaust outlet is opened by means of rotating the first rotatable part to a predefined angle relative to the second fixed part.

2. The method of claim 1, according to which the second underwater exhaust outlet is opened by means of non-coinciding, portions of the first and second openings.

3. The method of any claim 1, according to which the predefined angle is in the interval of 1-30 degrees.

4. The method of claim 1, according to which the predefined angle is in the interval of 5-20 degrees.

5. The method of claim 1, according to which the predefined angle is in the interval of 8-12 degrees.

6. The method of claim 1, according to which the second underwater exhaust outlet is a vent in an underwater housing of the propeller drive, which is arranged closer to the hull bottom of the boat than the first underwater exhaust outlet is.

7. A system for controlling the exit of exhaust gases from an engine which is arranged to power an underwater propeller drive which is arranged at the hull bottom of a boat, the system comprising a control unit and an exhaust channel for the exhaust gases with a first underwater exhaust outlet, the exhaust channel comprising a second underwater exhaust outlet arranged closer to the hull bottom of the boat than the first underwater exhaust outlet is, and the control unit being adapted to open the second underwater exhaust outlet for the exit of gases from the exhaust channel if the en sine is running and the transmission of the propeller drive is in a neutral position, wherein a first part of the underwater propeller drive is rotatable about a second part which is attached to the hull bottom of the boat, with the exhaust channel comprising a first opening in the first rotatable part which faces a second opening in the second fixed part, the first and second openings having corresponding forms and shapes so as to cooperate to form part of the exhaust channel, with the control unit being adapted to open the second underwater exhaust outlet by means of rotating the first rotatable part to a predefined angle relative to the second fixed part.

8. The system of claim 7 in which the second underwater exhaust outlet is opened by means of non-coinciding portions of the first and second openings.

9. The system of claim 7, in which the predefined angle is in the interval of 1-30 degrees.

10. The system of claim 7, in which the predefined angle is in the interval of 5-20 degrees.

11. The system of claim 7, in which the predefined angle is in the interval of 8-12 degrees.

12. The system of claim 7, in which the second underwater exhaust outlet is a vent in an underwater housing of the propeller drive, which is arranged closer to the hull bottom of the boat than the first underwater exhaust outlet is.

* * * * *